United States Patent [19]

Grunert et al.

[11] Patent Number: 4,650,940

[45] Date of Patent: Mar. 17, 1987

[54] CIRCUIT BREAKER WITH ARC GAS VENT BAFFLE

[75] Inventors: Kurt A. Grunert, Beaver; Roger E. Walker, Franklin Township, Beaver County; Charles R. Paton, New Brighton; David A. Leone, Aliquippa; David C. Turner, Industry, all of Pa.

[73] Assignee: Westinghouse Electric Corp., Pittsburgh, Pa.

[21] Appl. No.: 876,158

[22] Filed: Jun. 19, 1986

Related U.S. Application Data

[63] Continuation-in-part of Ser. No. 760,384, Jul. 30, 1985.

[51] Int. Cl.[4] ..... H01H 33/02

[52] U.S. Cl. ..... 200/144 R; 200/304

[58] Field of Search ..... 200/144 R, 304

[56] References Cited

U.S. PATENT DOCUMENTS 2,727,966 12/1955 Reichert et al. ..... 200/304

2,830,158 4/1958 Coleman ..... 200/144 R

FOREIGN PATENT DOCUMENTS 572865 2/1958 Italy ..... 200/304

*Primary Examiner*—Robert S. Macon

*Attorney, Agent, or Firm*—L. P. Johns

[57] ABSTRACT

A circuit breaker with an arc gas vent baffle characterized by a molded insulating housing containing circuit breaker and an arc quenching chamber, the housing having walls forming a compartment containing a terminal, the walls having spaced vent openings communicating with the compartment one of which openings is covered with a baffle to turn aside the flow of gases, and the baffle being yieldably mounted to permit access through the opening from the outside of the housing.

5 Claims, 5 Drawing Figures

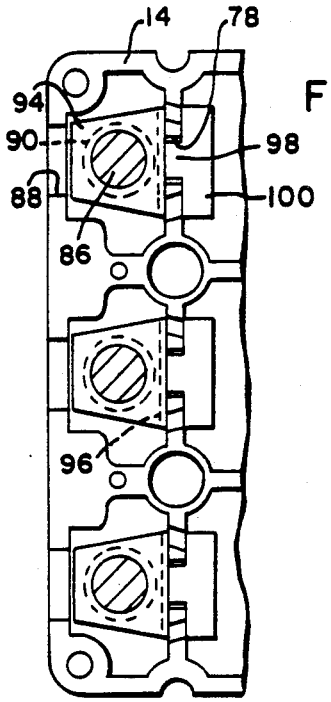
FIG. 2
FIG. 3
PRIOR ART
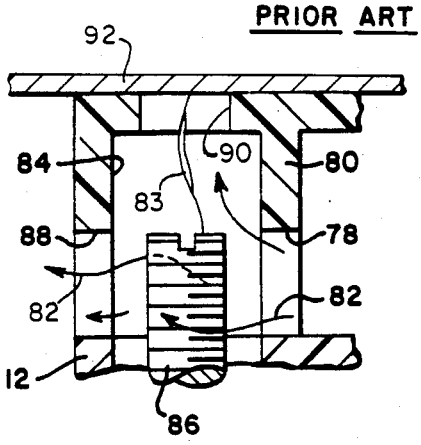
FIG. 4
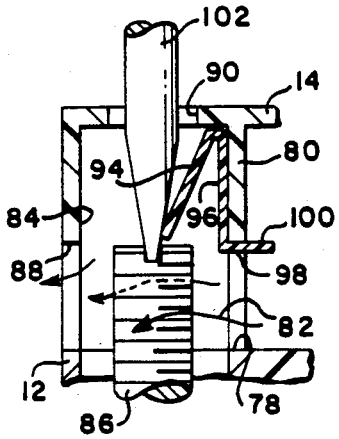
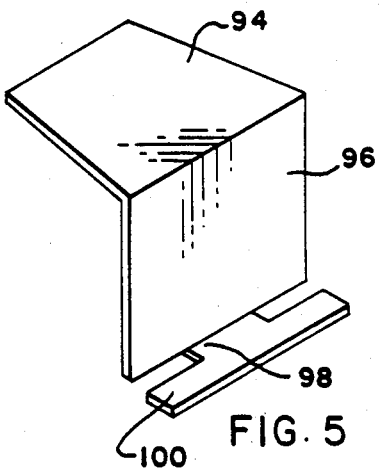
FIG. 5

CIRCUIT BREAKER WITH ARC GAS VENT BAFFLE

CROSS REFERENCE TO RELATED APPLICATION

This application is a continuation-in-part of copending U.S. patent application Ser. No. 760,384, filed July 30, 1985.

This application is related to the copending application Ser. No. 729,437 filed May 1, 1985, the invention of K. A. Grunert, R. E. Walker, C. R. Paton, and D. A. Leone (W. E. Case 52,632), assigned to the assignee of this application.

BACKGROUND OF THE INVENTION

1. Field of the Invention

This invention relates to a molded case circuit breaker, and more particularly, it pertains to a circuit breaker having a terminal barrier for avoiding electrical breakdown due to ionized gases exhausting from the arc extinguishing chamber.

2. Description of the Prior Art

When contacts of a circuit breaker are opened, an arc is usually created which is accompanied by the generation of ionized gases. This is particularly true for circuit breakers of small physical size with high interrupting ratings. Where wiring terminals are in close proximity to the circuit breaker vents for exhausting the gases, the problem is especially acute. The ionized arc gases can cause a phase-to-phase electrical failure between the terminals of the circuit breaker or a phase-to-ground electrical failure with any metallic enclosure within which the circuit breaker is mounted. Accordingly, there is a need for preventing these kinds of electrical breakdowns.

SUMMARY OF THE INVENTION

In accordance with this invention, a circuit breaker with an arc chamber vent is provided which comprises an electrically insulating housing including line and load terminals, an arc quenching chamber within the housing, a circuit breaker structure within the housing and having stationary and movable contacts operable between open and closed positions in an arcing zone within the chamber, the housing having wall means forming a compartment for containing each terminal and having openings between corresponding chambers and compartments, one of the openings being aligned with a terminal for access thereto, a baffle extending over the one opening to prevent any gases from flowing through said opening and thereby avoiding an electrical breakdown between the terminals and/or any proximate electrical conductor, and the baffle being deflectable by any tool inserted through the opening for adjustment of the terminal.

The advantage of the device of this invention is that in the event of an out gassing due to an arc in the extinguishing chamber, sufficient pressure is produced to not only move a flap against an access hole, but also provide an increased seal as the pressure of the gas increases.

BRIEF DESCRIPTION OF THE DRAWINGS

FIG. 2 is a horizontal sectional view taken on the line II—II of FIG. 1;

FIG. 3 is a fragmentary sectional view of a prior art structure;

FIG. 4 is a fragmentary sectional view showing the manner in which a gas baffle is deflected upon insertion of a screw driver into the arc chamber vent; and FIG. 5 is an isometric view of the baffle structure.

DESCRIPTION OF THE PREFERRED EMBODIMENT

Figure 1:
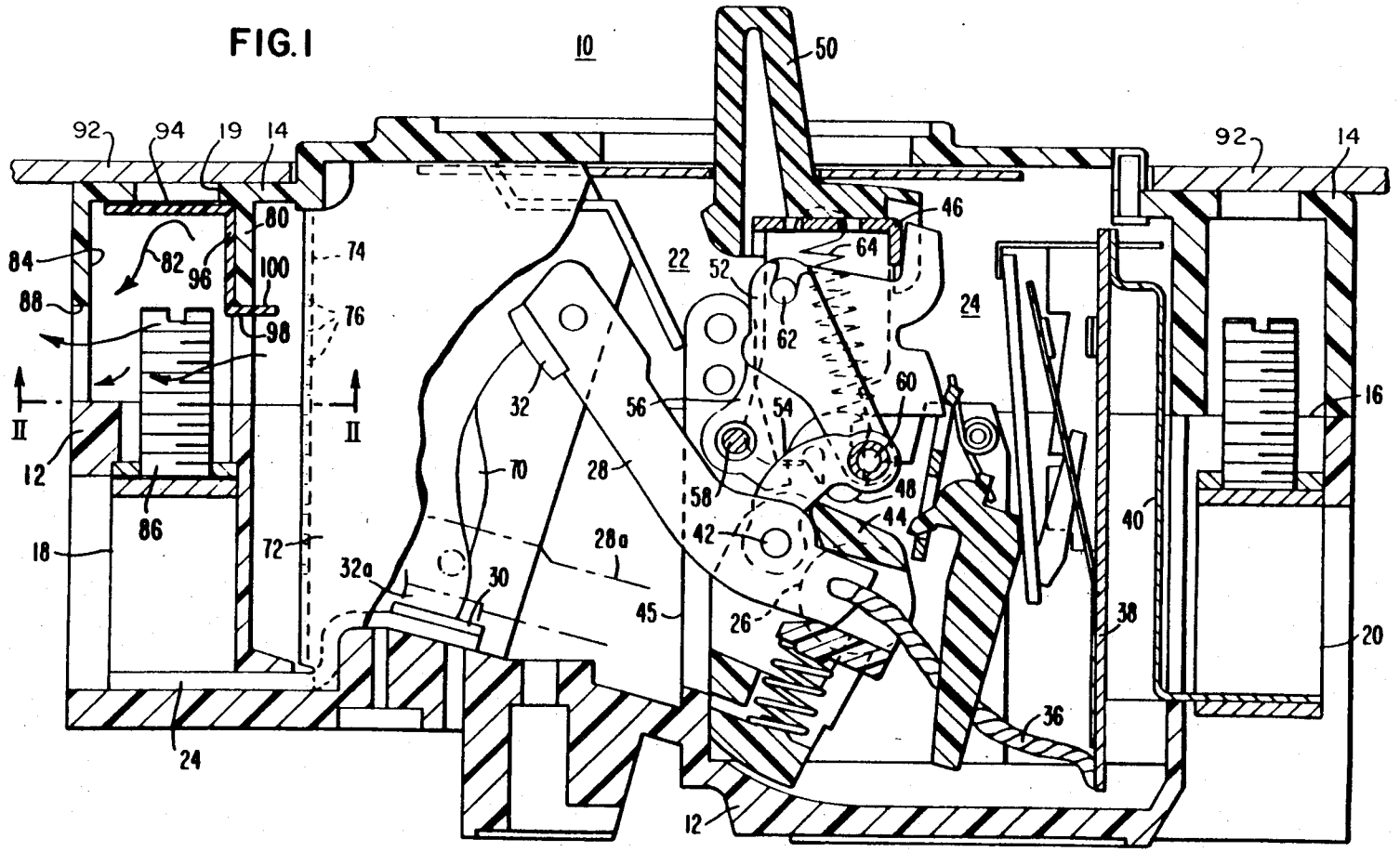
FIG. 1 is a vertical sectional view through a circuit breaker showing the arc chamber vent of this invention.

In FIG. 1 a molded case circuit breaker is generally indicated at 10 and includes a molded, electrically insulating housing or base 12 having a cover 14 which is mechanically attached at a parting line 16 where it is retained in place by a plurality of fasteners such as screws (not shown). A line terminal 18 is disposed at one end of the housing 12 and a load terminal 20 is disclosed at the other end. Although the circuit breaker 10 is disclosed as a single phase structure, it is particularly applicable to polyphase circuit interrupters such as a three phase or three pole circuit breaker. For a polyphase circuit breaker, a pair of similar terminals 18, 20 are provided for each phase. The terminals 18, 20 are employed to serially electrically connect the circuit breaker 10 into an electrical circuit, such as a three phase circuit, to protect the electrical system involved.

The circuit breaker 10 comprises an operating mechanism 22, a trip device 24, a tie bar 26, a contact arm 28, and a pair of separable contacts including a fixed contact 30 and a movable contact 32.

Although the circuit breaker 10 (FIG. 1) is disclosed in the tripped position with the contacts 30, 32 separated, the closed position of the arm 28 is shown at **28*a* with the contacts 30, 32 in closed position. In that position a circuit through the circuit breaker extends from the terminal 18 through a conductor 24, the contacts 30, 32, the contact arm 28, a shunt 36, a thermal trip device 38, a conductor 40 to the terminal 20**.

The contact arm 28 is pivotally connected at a pin 42 to a rotating carriage 44, which is secured to or integral with the insulating tie bar 26. The contact arm 28 and the carriage 44 accordingly rotate as a unit with the tie bar 26 during normal current conditions through the circuit breaker 10.

The single operating mechanism 22 is typically of that set forth in U.S. Pat. No. 4,503,408. The mechanism 22 is positioned in the center pole unit of a three pole circuit breaker and is supported between spaced plates (one of which plates 45 is shown) which are fixedly secured to the base 12 of the center pole unit. An inverted U-shaped operating lever 46 is pivotally supported on the plates 45 with the ends of the legs of the lever supported in U-shaped notches 48 of the plates.

A handle 50 for manual operation of the mechanism 22 is on the U-shaped operating lever 46. The mechanism 22 also comprises an overcenter toggle having an upper toggle link 52 and a lower toggle link 54 which connect the contact arm 28 to a releasable member or cradle 56 that is pivotally supported on the plates 45 by means of a pin 58. The toggle links 52, 54 are pivotally connected by means of a knee pivot pin 60. The toggle link 52 is pivotally connected at 62 to the cradle 56 and the link 54 is pivotally connected to the rotating carriage 44 at the pivot pin 42. Overcenter operating springs 64 are connected under tension between the knee pivot pin 60 and the bight portion of the lever 46.

Contacts 30, 32 are normally manually opened by movement of the handle 50 to the right to the position shown in FIG. 1 from the ON to the OFF position.

However, inasmuch as a latch lever 66 of the trip device 24 is disengaged from a notch 68 in the cradle 56, the circuit breaker 10 is in the tripped position (FIG. 1). For an explanation of resetting of the circuit breaker, reference is further made to U.S. Pat. No. 4,503,408.

For the purpose of this invention, the circuit breaker operating mechanism 22 may be tripped solely by a trip device 24 including the thermal trip device or bimetal 38. Other means for tripping, such as separate high speed electromagnetic trip devices, are described elsewhere such as in U.S. Pat. No. 4,220,935.

When the operating mechanism 22 is tripped, by whatever means, such as the trip device 24, the contact arm 28 moves from the broken line position 28*a* to the open position (FIG. 1). As a consequence, an electric arc 70 is normally generated between the contacts 30, 32. As a result, ionized gases occur which require venting to the outside of the circuit breaker to minimize related problems that otherwise may occur. An arc extinguishing device or arc chute 72 is disposed around the contact arm 28 to facilitate extinguishment of the arc in a well-known manner. For venting of the gases from the arc chute, a back wall 74 of the arc chute is provided with a plurality of vent holes 76 through which the gases pass under pressure (FIGS. 1, 2, 4) and through openings 78 in a wall 80 of the cover 14.

As shown in the prior art structure (FIG. 3) the gases flowed, as shown by arrows 82, through compartment 84 and around a terminal screw 86 of wiring terminal 18 from where the gases flow through outlets 88 and 90 into the atmosphere. The ionized arc gases 82 often caused phase-to-phase or phase-to-ground electrical breakdown between the terminal screw 86 and any proximate metal parts, such as steel cover plate 92, within which the circuit breaker is mounted. A breakdown of this type, such as an arc 93, can develop into a ground fault and, if severe enough, cause an electrical breakdown outside the breaker.

In accordance with this invention baffle means are provided for closing the opening 90 and thereby preventing electrical breakdown due to the passage of ionized gases through the opening. As shown more particularly in FIG. 1, the baffle means includes a flap or barrier 94 which is disposed within the compartment 84 and over the inner side of the opening 90. By extending across the opening 90 the ionized gases flowing into the compartment 84 are deflected by the flap 94 toward the opening 88. As the gas enters the chamber through the openings 78 in the wall 80, sufficient pressure is produced to not only move the flap 94 against the opening 90, but to also provide an increased seal as the pressure increases. Thus, electrical breakdown between the screw 86 and the cover plate 83 external of the circuit breaker or near the opening 90 is avoided.

The flap 94 is preferably composed of a sheet of fiber or fiber type material which is chemically and electrically impervious to the hot ionized gases to which it is exposed. More particularly, the sheet of fiber material is folded into the configuration shown in FIG. 5, whereby the flap 94 is folded and includes integral parts 96, 98, and 100 which are adapted as necessary to fit snugly against wall surfaces of the compartment 84 and opening 78 (FIG. 1). A suitable adhesive may be provided between corresponding wall surfaces of the wall 80 and corresponding parts 96, 98 to retain the flap 94 in place.

As shown in FIG. 4, before the panel cover 92 is mounted over the circuit breaker 10, the flap 94 is deflected when a tool, such as a screw driver 102, is inserted through the opening 90 for turning of the screw 86 which screw is aligned with the opening. Upon withdrawal of the screw driver 102 the flap 94 returns to the position shown in FIG. 1. Finally, due to closing of the opening 90 by the flap 94 all of the ionized arc gases 82 move through the opening 88 under greater pressure into the ambient air where the gas dissipates to harmless status.

In conclusion, the baffle means prevents out gassing in such directions as to preclude an extension of an arc from the arc extinguishing chamber through the terminal compartment.

What is claimed is:

1. A circuit breaker with an arc chamber vent baffle, comprising:

an electrically insulating housing including line and load terminals;

an arc quenching chamber within the housing;

a. circuit breaker structure within the housing and having stationary and movable contacts operable between open and closed positions in an arcing zone within the chamber;

the housing having wall means forming a compartment for containing each terminal and having openings between the corresponding chambers and compartments;

one of the openings being aligned with a terminal for access thereto;

baffle means extending over the one opening to prevent any arc gases from flowing through the one opening and thereby avoiding a phase-to-ground electrical breakdown between the terminal and any proximate electrical conductor adjacent to the one opening; and the baffle means being deflectable by any tool inserted through the one opening for adjustment of the terminal.

2. The circuit breaker of claim 1 in which the baffle means is disposed within the compartment.

3. The circuit breaker of claim 2 in which the baffle means comprises a flap yieldably extending over the one opening.

4. The circuit breaker of claim 3 in which the flap is composed of fiber sheet material.

5. The circuit breaker of claim 4 in which the flap is a portion of a prefolded fiber sheet and having an attached portion for attachment to the housing wall means.

* * * * *